United States Patent [19]

Tojo et al.

[11] 4,157,722

[45] Jun. 12, 1979

[54] WEFT YARN GRASPING APPARATUS FOR FLUID JET LOOM

[75] Inventors: Akio Tojo, Higashimurayama; Kimimasa Ohnishi, Tokyo; Isamu Hosono; Mikiyoshi Ogawa, both of Yokohama, all of Japan

[73] Assignee: Nissan Motor Company, Limited, Japan

[21] Appl. No.: 859,097

[22] Filed: Dec. 9, 1977

[30] Foreign Application Priority Data

Mar. 26, 1977 [JP] Japan ..... 52/32798

[51] Int. Cl.[2] ..... D03D 47/34

[52] U.S. Cl. ..... 139/450; 242/150 R; 112/255; 139/1 C

[58] Field of Search ..... 139/1 C, 194, 435, 450, 139/452; 112/DIG. 3, 254, 255; 242/150

[56] References Cited

U.S. PATENT DOCUMENTS

| | | | |
|---|---|---|---|
| 2,158,197 | 5/1939 | Pikul | 112/255 |
| 2,646,944 | 7/1953 | Heffelfinger | 242/150 |
| 3,181,569 | 5/1965 | Carroll | 139/450 |
| 3,348,582 | 10/1967 | Brookshire | 139/450 |
| 3,542,595 | 11/1970 | McCullough et al. | 139/1 C |

*Primary Examiner*—Henry Jaudon

*Attorney, Agent, or Firm*—Robert E. Burns; Emmanuel J. Lobato; Bruce L. Adams

[57] ABSTRACT

When weaving, movable and stationary discs grasp or grip intermittently the weft yarn therebetween. One of the discs has at its contacting surface a circular recess encircled by a bank. The ridge of the bank contacting the flat surface of the other disc does the gripping.

8 Claims, 6 Drawing Figures

WEFT YARN GRASPING APPARATUS FOR FLUID JET LOOM

FIELD OF THE INVENTION

FIELD OF THE INVENTION

The present invention relates in general to a fluid jet weaving loom, such as water jet loom or air jet loom, and more particularly to a weft yarn grasping means for the loom, the grasping means functioning to selectively grasp and release the weft yarn which is inserted into the shed of the warp yarns by the aid of fluid jet stream in response to the weaving operation of the loom.

BACKGROUND OF THE INVENTION

In a fluid jet weaving loom, a so-called weft yarn grasping apparatus is employed for alternately grasping and releasing the weft yarn which is to be inserted in the shed of the warp yarns. Widely used grasping apparatus are of a type comprising a stationary disc member and a movable disc member which are axially aligned to be contactable with and separable from each other, the movable disc member being reciprocably movable with respect to the stationary disc member so as to intermittently form a clearance through which the weft yarn is passed. In grasping of the weft yarn, the movable disc member is brought into contact with the stationary disc member to strongly press the weft yarn to the stationary disc member. Upon releasing of the weft yarn, the movable disc member is completely separated from the stationary disc member to form a large clearance therebetween. Usually, the movable disc member is arranged rotatable axially relative to the stationary disc member and the contacting surfaces of the stationary and movable disc members are substantially entirely flat. In this type grasping apparatus, however, it inevitably occurs, upon long time usage thereof, that the peripheral portions of these disc members are greatly worn out with a result that the actual grasping of the weft yarn is made only by generally central portions of these disc members. The grasping ability of the apparatus is thus reduced causing the failure of picking of the weft yarn into the shed.

SUMMARY OF THE INVENTION

Accordingly, the present invention contemplates to eliminate the drawback encountered in the above-mentioned type weft yarn grasping apparatus.

It is an object of the present invention to provide an improved weft yarn grasping apparatus by which the weft yarn is assuredly and reliably grasped and released thereby contributing substantially to production of high quality fabric.

It is another object of the present invention to provide an improved weft yarn grasping apparatus which can be produced by only slightly modifying the conventional weft yarn grasping apparatus.

SUMMARY OF THE DRAWINGS

Other objects and advantages of the present invention will become clear from the following description when taken in conjunction with the accompanying drawings, in which.

DESCRIPTION OF THE PREFERRED EMBODIMENTS

Prior to the detailed description of the weft yarn grasping apparatus of the invention, general explanation of the air jet weaving loom will be given with the aid of FIG. 1 in order to clarify the subject invention.

Figure 1:
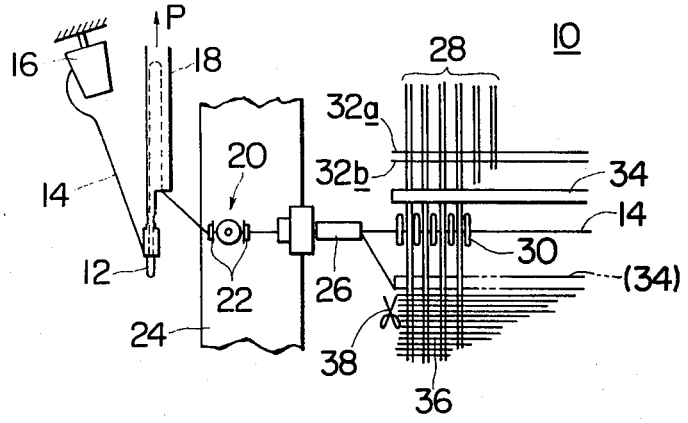
FIG. 1 is schematic view of an air jet weaving loom employing therein a weft yarn grasping apparatus according to the present invention.

In FIG. 1, the air jet weaving loom is illustrated as being generally designated by numeral 10. The loom 10 comprises a weft yarn measuring device 12 by which a predetermined length of weft yarn 14 is withdrawn from a weft yarn supply 16. A weft yarn storage tube 18 is arranged to receive therein the predetermined length of the weft yarn 14 by the aid of an air stream flowing in the illustrated direction P. Denoted by numeral 20 is weft yarn grasping apparatus by which the weft yarn 14 from the storage tube 18 is alternately grasped and released. For guiding the weft yarn 14 received by the grasping apparatus 20, two guide members 22 are arranged upstream and downstream of the apparatus 20. Denoted by numeral 24 is a frame member of the loom 10 on which member the grasping apparatus 20 and the guide members 22 are mounted. An air jet nozzle 26 located downstream of the grasping apparatus 20 is formed to receive therein the weft yarn 14 from the grasping apparatus 20 for throwing the same into a shed (no numeral) of parallelly arranged warp yarns 28 by the aid of pressurized air ejected from the nozzle 26. The pressurized air is guided by a comb-shaped air guide 30 for assuring the insertion of the weft yarn 14 into the shed. Designated by numerals **32*a* and 32*b* are heddles which form the warp yarn shed. A reed 34 is arranged to beat up the weft yarn 14 just inserted into the shed from the nozzle 26 thereby to form a fabric 36. A cutter 38 is placed on each side of the fabric 36 to cut the end sections of the inserted weft yarn 14 after the beating-up by the reed 34**.

Figure 2:
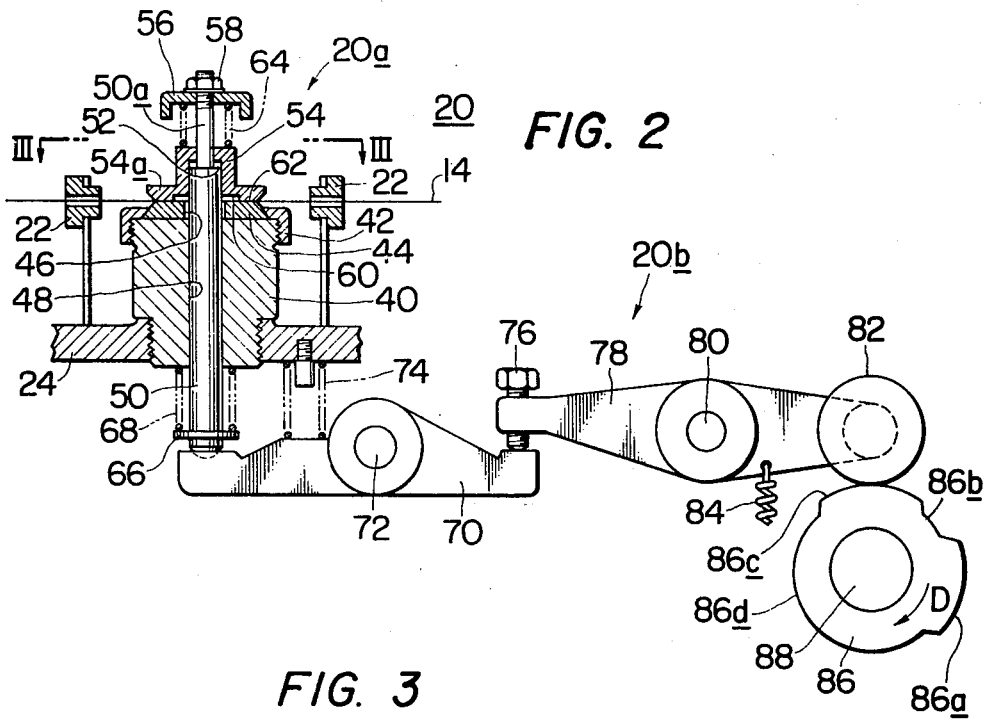
FIG. 2 is an enlarged sectional view of a first preferred embodiment of a weft yarn grasping apparatus of the present invention.

Referring to FIG. 2, there is shown the detailed construction of the weft yarn grasping apparatus 20 employed in the loom 10 shown in FIG. 1. As has been mentioned, the apparatus 20 is a first preferred embodiment of the subject invention. The grasping apparatus 20 comprises in general a first or gripping section **20*a* and a second or actuating section 20*b***.

Figure 3:
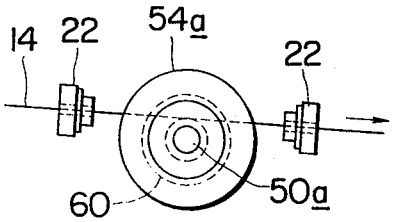
FIG. 3 is a sectional view taken along the line III—III of FIG. 2.

The first section **20*a* comprises a cylindrical base member 40 which has a lower section thereof threaded in an opening (no numeral) formed in the frame member 24 of the loom 10 and an upper section thereof to which a holding ring 42 is screwed. The holding ring 42 has a center opening (no numeral) through which a stationary disc member 44 constructed of a ceramic or a metal is tightly attached onto an upper portion of the base member 40. The stationary disc member 44 has a substantially flat upper surface. The stationary disc member 44 and the base member 40 are respectively formed with a center opening 46 and a center passage 48 which are vertically aligned to slidably receive therein a reciprocating rod 50. The reciprocating rod 50 has at its upper section a small diameter stem portion 50***a* to form a shoulder 52 therebetween. As shown, the small diameter stem portion 50*a* slidably passes through an opening (no numeral) formed in the base of a cup-shaped disc member 54, and then axially rotatably contacts at its top end a stop member 56 via a connecting nut 58. The cup-shaped disc member 54 is constructed of a fluorine-containing plastic (Teflon) and has a cylindrical portion (no numeral) slidably receiving therein a large diameter or main portion of the rod 50 and has a flange portion 54*a* extending radially outwardly from the cylindrical portion. The flange portion 54*a*, when the cup-shaped disc member 54 is moved toward the stationary disc member 44, is contactable with the flat upper surface of the stationary disc member 44 to grasp the weft yarn 14 passing therebetween. Hereinlater, the cup-shaped disc member 54 will be referred to as a movable disc member for facilitation. For the reasons which will be clearly described hereinafter, the flange portion 54*a* is formed with a concentric circular recess 60 forming a circular bank 62 on the periphery of the flange portion 54*a*. Thus, the gripping of the weft yarn 14 occurs when the ridge of the circular bank 62 is brought into contact with the flat surface of the stationary disc member 44. The configuration of the circular recess 60 in the flange portion 54*a* will be clearly understood from FIG. 3. As shown in this drawing, the weft yarn 14 is arranged to cross the recess 60. A compression spring 64 is concentrically disposed around the stem portion 50*a* of the rod 50 between the stop member 56 and the base of the movable disc member 54 so that the movable disc member is biased downwardly that is in a direction toward the stationary disc member 44 as seen in FIG. 2. The rod 50 is equipped at its lower end section with a retainer 66 which projects from the base member 40, for disposing a compression spring 68 between it and the base member 40 to urge the reciprocating rod 50 downwardly. Now, it should be noted that the biasing force produced by the spring 64 is set sufficiently smaller than that of the spring 68.

For intermittently pushing up the rod 50 against the biasing force produced by the spring 58, the second or actuating section 20*b* is employed, which comprises a first lever 70 pivotally supported at its fulcrum 72. The first lever 70 has a left end (no numeral) contactable with a convex surface formed on the downwardly extending end of the reciprocating rod 50. A spring 74 is disposed between the left side of the lever 70 and the frame member 24 to urge the lever 70 in a counterclockwise direction in this drawing. The first lever 70 has a right end (no numeral) which is contactable with a lower end of an adjusting screw 76 fixed to a second lever 78. The second lever 78 is pivotally supported at its fulcrum 80 and has a left end (no numeral) to which the adjusting screw 76 is adjustably fixed and a right end (no numeral) to which a cam follower 82 is rotatably fixed. A tension spring 84 is fixed to the right side of the second lever 78 for biasing the same to rotate in a clockwise direction forcing the cam follower 82 to operatively engage with a cam 86 which is connected to its axis 88. The axis 88 is synchronized to rotate one per pick of the loom 10, in a clockwise direction as viewed by the arrow D. The cam 86 has first and second projected cam surfaces 86*a* and 86*c* and first and second non-projected cam surfaces 86*b* and 86*d* in the illustrated manner. It should be now noted that the effective height of the first projected cam surface 86*a* is somewhat greater than that of the second projected cam surface 86*c*.

With the above, it will be appreciated that when reciprocating rod 50 of the gripping section 20*a* is not given an upwardly biasing force by the first lever 70, the rod 50 locates at its lower-most position with a result that the stop member 56 strongly urges through the spring 64 the movable disc member 54 toward the stationary disc member 44. Under this state, the weft yarn 14 is tightly and strongly gripped by the gripping section 20*a*. While, when the rod 50 is lifted upwardly a slight predetermined distance by the first lever 70, the stop member 56 is moved away from the movable disc member 54 while keeping the same at its previous position by the aid of the spring 64. Under this state, the gripping force applied to the weft yarn is reduced to such a value that the sandwiched weft yarn 14 is permitted to slipperily slide in the gripping section 20*a* when it is pulled by a predetermined magnitude of force in its travelling direction. Furthermore, when the rod 50 is lifted up more by the first lever 70, the shoulder 52 of the rod 50 is brought into contact with the base of the movable disc member 54 and finally, the movable disc member 54 is lifted to a position to form a large clearance between the leading top end of the circular bank 62 and the upper surface of the stationary disc member 44. Under this state, the weft yarn 14 is completely released from the gripping section 20*a*.

With this, the operation of the weft yarn grasping apparatus 20 is as follows. To facilitate the explanation of the operation, it will be given with the aid of FIG. 1.

When picking the weft yarn 14 into the shed of the warp yarn 28, the cam 86 takes a position wherein the first projected cam surface 86*a* engages the cam follower 82, thus inducing the first lever 70 to push up the reciprocating rod 50 to its uppermost position with a result that the movable disc member 54 is lifted up to completely release the weft yarn 14 from the gripping section 20*a*. Thus, the weft yarn picking is assuredly accomplished.

After insertion of the weft yarn 14 into the shed, the cam 86 is rotated to take a position wherein the first non-projected cam surface 86*b* receives the cam follower 82. Under this, the first lever 70 swings in a counterclockwise direction by biasing actions of the springs 68 and 74 in response to the clockwise swing of the second lever 78. Thus, the rod 50 moves downwardly by the action of the spring 68 to its lowermost position causing the gripping section 20*a* to tightly and strongly grip the weft yarn 14.

When beat-up by the reed 34 occurs, the cam 86 takes a position wherein the second projected cam surface 86*c* engages with the cam follower 82, as seen in FIG. 2. Under this, the first lever 70 is rotated to slightly lift up the reciprocating rod 50 moving away the stop member 56 from the movable disc member 54 while keeping the same at its previously set position. Thus, as has been described hereinbefore, the gripping force applied to the sandwiched weft yarn 14 is somewhat reduced. In this state, the gripping force to the weft yarn 14 is produced only by the reduced force of the spring 64. Accordingly, if the weft yarn 14 inserted in the warp yarn shed is subjected to an abnormal tension during the beat-up the reed 34, the gripping section 20*a* permits the slippage of the sandwiched weft yarn 114 thereby substantially eliminating weft yarn breakage.

After the beat-up by the reed 34, the cam 86 takes a position wherein the second non-projected cam surface 86*d* engages with the cam follower 82 thus causing the gripping section 20*a* to tightly and strongly grip the weft yarn 14.

It should be now noted that since the movable disc member 54 is formed with the circular recess 60 forming the bank 62 and the movable disc member 54 is arranged rotatable about the axis thereof relative to the stationary disc member 44, the ridge of the bank 62 and thus the contacting surface of the stationary disc member 44 wear evenly. Accordingly, the effective grasping function of the grasping apparatus 20 to the weft yarn 14 lasts for a long time in comparison with the conventional grasping apparatus.

Figure 4:
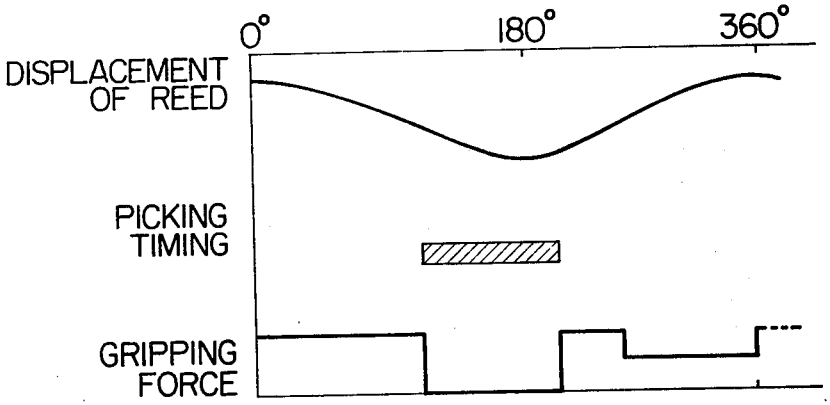
FIG. 4 is a graph showing the relationship between the zone in which picking of the weft yarn into the shed of the warp yarns is possible and the gripping force applied to the weft yarn by the grasping apparatus with respect to the movement of the reed from one beat to another.

FIG. 4 shows graphically in terms of the cyclic displacement of the reed 34 from one beat up position to the next, the zone in which picking of the weft yarn 14 into the shed is possible and the gripping force applied to the weft yarn by the gripping section 20*a*.

Figure 5:
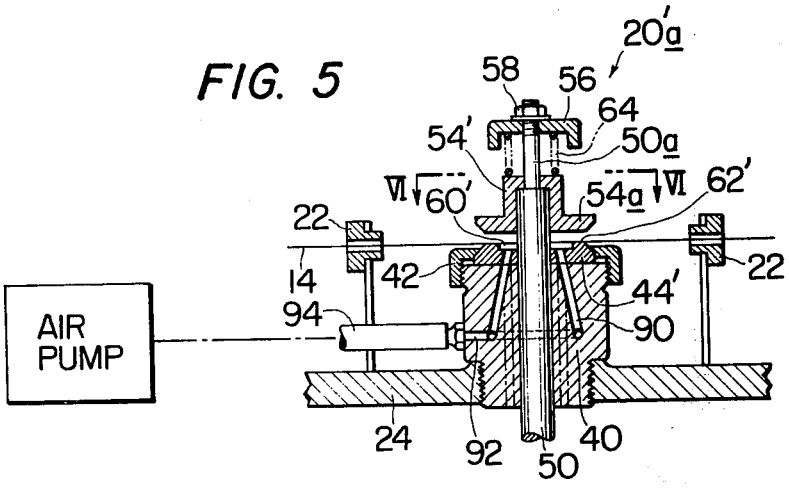
FIG. 5 is a view similar to FIG. 2, but shows a second preferred embodiment of the present invention.

Referring to FIG. 5, there is shown a gripping section of a weft yarn grasping apparatus as being designated by numeral 20'*a*. Like parts are denoted by the same numerals as in the case of the first embodiment of FIG. 2.

Figure 6:
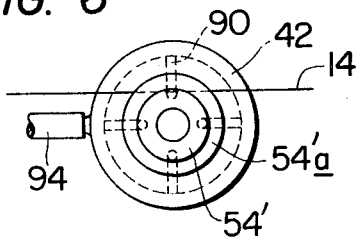
FIG. 6 is a sectional view taken along the line VI—VI of FIG. 5.

As is shown in FIG. 5, the gripping section 20'*a* of the second embodiment is very similar in construction to that of the first embodiment except for the following:

The stationary disc member 44' is formed with a concentric circular recess 60', in place of the recess 60 of the movable disc member 54 of the first embodiment, thus forming a circular bank 62' on the periphery thereof. A plurality of passages 90 (four passages in this case) are formed in the base member 40 at evenly spaced intervals to open to the circular recess 60' of the stationary disc member 44', as well known in FIG. 6. The passages 90 are fluidly connected via a passage 92 also formed in the base member 40 to a tube 94 leading to an air supply pump (shown in block) by which compressed air flows through the tube 94 toward the passages 90. Thus, any lint and other miscellanea collected or gathered in the circular recess 60' are blown off under operation of the grasping section 20'*a*.

In addition to the above, the following modifications are available in the second embodiment.

An air suction pump may be used, in place of the air supply pump, for forming a stream of air flowing toward the air suction pump. In this case however, it is desirable to mount an air filter at a position upstream of the pump.

Furthermore, if desired, a plurality of large diameter through passages can be provided in the base member 40 to vertically extend vertically from the circular recess 60' to the lower end of the base member 40, as shown by phantom lines in FIG. 5. In this case, the lint and the miscellanea in the recess 60' can be removed without using the air pumps, since such contaminants are forced to travel downwardly through the passages for the final dropping thereof from the passages in response to the stamping operation of the movable disc member 54'*a*.

Now, it should be noted that, of the stationary and movable disc members, the member with the recess will be constructed of the plastic material for facilitation of forming the recess. The plastic material should be selected from the group having low friction coefficient and high wear-resistance in order to obtain a desirable gripping function.

What is claimed is:

1. A weft yarn grasping apparatus for a fluid jet weaving loom for alternately grasping and releasing a weft yarn to be inserted in the shed of warp yarns to form a fabric, said apparatus comprising:

aligned stationary and movable members respectively having surface portions facing each other, said movable member being reciprocally movable with respect to said stationary member in response to the weaving operation of said loom to intermittently define between said surface portions a clearance through which said weft yarn passes, said stationary member having a recess in the corresponding surface portion to define on the same a bank which surrounds said recess, the surface portion of said movable member being brought into contact with the ridge of said bank to press the weft yarn on the same when gripping of said weft yarn is required, said stationary member having at least one unobstructed through cleaning passage which has one end open to said recess and the other end open to the open air so that lint and miscellanea may pass there through at a portion.

2. A weft yarn grasping apparatus as claimed in claim 1, further comprising an air pump means which communicates with the other end of said through passage to form a stream of air in said through passage upon energization of said air pump means.

3. A weft yarn grasping apparatus as claimed in claim 2, in which said air pump means is an air supply pump by which compressed air flows in the direction from said pump toward said recess of said stationary member.

4. A weft yarn grasping apparatus as claimed in claim 2, in which said air pump means is an air suction pump by which air flows in the direction from said recess toward said pump.

5. A weft yarn grasping apparatus as claimed in claim 1, in which said at least one passage in said stationary member is a plurality of passages in said stationary member at evenly spaced intervals.

6. A weft yarn grasping apparatus as claimed in claim 1, in which one of said movable and stationary members is constructed of a plastic having a low friction coefficient and high wear-resistance properties.

7. A weft yarn grasping apparatus as claimed in claim 1, further comprising means for guiding said weft yarn to cross said recess.

8. A weft yarn grasping apparatus as claimed in claim 1, in which said stationary member is a discal member and said recess is circular thereby to cause said bank to be concentric with said stationary member.

* * * * *